US011353025B2

(12) United States Patent
Wang et al.

(10) Patent No.: US 11,353,025 B2
(45) Date of Patent: Jun. 7, 2022

(54) DUAL-CYLINDER TWO-STAGE VARIABLE CPACITY COMPRESSOR

(71) Applicant: SHANGHAI HIGHLY ELECTRICAL APPLIANCES CO., LTD., Shanghai (CN)

(72) Inventors: Yanzhen Wang, Shanghai (CN); Jin Pan, Shanghai (CN); Chunhui Liu, Shanghai (CN)

(73) Assignee: SHANGHAI HIGHLY ELECTRICAL APPLIANCES CO., LTD., Shanghai (CN)

( * ) Notice: Subject to any disclaimer, the term of this patent is extended or adjusted under 35 U.S.C. 154(b) by 0 days.

(21) Appl. No.: 17/059,294

(22) PCT Filed: Dec. 27, 2019

(86) PCT No.: PCT/CN2019/129065
§ 371 (c)(1),
(2) Date: Nov. 27, 2020

(87) PCT Pub. No.: WO2020/211449
PCT Pub. Date: Oct. 22, 2020

(65) Prior Publication Data

US 2022/0034320 A1 Feb. 3, 2022

(30) Foreign Application Priority Data

Apr. 17, 2019 (CN) ..... 201910308326.3

(51) Int. Cl.
*F04C 23/00* (2006.01)
*F04C 18/356* (2006.01)
(Continued)

(52) U.S. Cl.
CPC ..... *F04C 23/001* (2013.01); *F04C 18/356* (2013.01); *F04C 28/26* (2013.01); *F04C 29/00* (2013.01); *F04C 29/12* (2013.01)

(58) Field of Classification Search
CPC ..... F04C 23/001; F04C 18/356; F04C 28/26; F04C 29/00; F04C 29/12
See application file for complete search history.

(56) References Cited

U.S. PATENT DOCUMENTS 5,152,156 A 10/1992 Tokairin
10,502,210 B2 * 12/2019 Gao ..... F04C 23/001

FOREIGN PATENT DOCUMENTS

CN 1955477 A 5/2007
CN 2911259 Y 6/2007
(Continued)

OTHER PUBLICATIONS

The 1st Office Action dated Feb. 23, 2021 for CN patent application No. 201910308326.3.
The ISR dated Mar. 25, 2020 by the WIPO.

*Primary Examiner* — Mary Davis
(74) *Attorney, Agent, or Firm* — Qinghong Xu

(57) ABSTRACT

A dual-cylinder two-stage variable capacity compressor is provided, including: a first cylinder, having an exhaust port connected to a first exhaust channel: a second cylinder, wherein the second cylinder is provided with a ventilating slider, and the ventilating slider is provided with a first gas transit channel and a second gas transit channel; wherein, when the ventilating slider is at a first connecting position, the first exhaust channel is connected to a suction channel in a second cylinder when the ventilating slider is at a second connecting position, the first exhaust channel is connected to a second exhaust channel. The compressor of the present disclosure can vary its own capacity, that is, the variation of the compressor's capacity can be realized by arranging a
(Continued)

ventilating slider, which will meet the requirements of variation loads of the compressor in different seasons.

10 Claims, 6 Drawing Sheets

(51) Int. Cl.

| | |
|---|---|
| ***F04C 28/26*** | (2006.01) |
| ***F04C 29/00*** | (2006.01) |
| ***F04C 29/12*** | (2006.01) |

(56) References Cited

FOREIGN PATENT DOCUMENTS

| | | | |
|---|---|---|---|
| CN | 202203116 | U | 4/2012 |
| CN | 102889210 | A | 1/2013 |
| CN | 203248363 | U | 10/2013 |
| CN | 107489622 | A | 12/2017 |
| CN | 207999521 | U | 10/2018 |
| CN | 208718928 | U | 4/2019 |

* cited by examiner

DUAL-CYLINDER TWO-STAGE VARIABLE CPACITY COMPRESSOR

CROSS-REFERENCE TO RELATED APPLICATIONS

This application is based upon PCT patent application No. PCT/CN2019/129065, filed Dec. 27, 2019, which claims priority to Chinese Patent Application No. 201910308326.3, filed Apr. 17, 2019, the entire contents of which are incorporated herein by reference.

TECHNICAL FIELD

The present disclosure generally relates to the fields of a compressor, and more particularly, to a dual-cylinder two-stage variable capacity compressor.

BACKGROUND

Nowadays, air conditioners are used more and more frequently. In order to improve the quality of life, the air conditioner will also be turned on in spring and autumn. When the air conditioner is used in spring and autumn, a temperature difference between indoor and outdoor is small, and a load of the air conditioner is lighter. However, in winter, users hope that the air conditioner can blow out hot air as soon as they arrive at home, that is, the air conditioner can operate at a heavy load. If both rapid heating in winter and operation at a very small load in spring and autumn are required for the air conditioner, the compressor must have the above two characteristics, which means that a capacity (volume flow) of the compressor can be varied according to the load. The capacity of the compressor used in the traditional air conditioner is fixed and immutable. Instead, the load of the air conditioner can be varied through frequency conversion technology, changing input current or digital scroll technology. However, the former technology is unable to meet the temperature control requirements of the four seasons, and the latter is gradually abandoned due to technical defects such as fluctuating noise, frequent switching noise of electronic expansion valves, and pulse noise of refrigerant flow. Therefore, it is necessary to design a compressor with its own variable capacity to meet a larger load variation range and realize the load variation of the air conditioner.

SUMMARY

In view of the problems of the existing technology, the object of the present disclosure is providing a dual-cylinder two-stage variable capacity compressor. The compressor of the present disclosure can vary its own capacity, that is, by arranging a gas exchange slider on the side wall of the cylinder, the variation of the compressor's capacity can be realized, which will meet the requirements of variation loads of the compressor in different seasons. When the temperature difference between indoor and outdoor is small, the gas exchange slider is in a first connecting position, compressed gas in an exhaust chamber in a first cylinder is directly introduced to a suction chamber in a second cylinder, which reduces the capacity of the compressor, and the compressor can operate at partial load and continuously operate at low load; When the temperature difference between indoor and outdoor is large, the gas exchange slider is in a second connecting position. Compared with when the gas exchange slider in the first connecting position, the capacity of the compressor is increased and the compressor can continuously operate at full load.

In some embodiments of the present disclosure, a dual-cylinder two-stage variable capacity compressor is provided. The variable capacity compressor includes: a first cylinder, having an exhaust port connected to a first exhaust channel; a second cylinder, wherein the second cylinder and the first cylinder are separated by a middle plate, the second cylinder is provided with a gas exchange slider, and the gas exchange slider is provided with a first gas transit channel and a second gas transit channel; wherein, when the gas exchange slider is at a. first connecting position, the first exhaust channel is connected to a suction channel in a second cylinder through the first gas transit channel; when the gas exchange slider is at a second connecting position, the first exhaust channel is connected to a second exhaust channel through the second gas transit channel, the second exhaust channel is connected to an inner chamber of the compressor.

Furthermore, the first cylinder is an upper cylinder and the second cylinder is a lower cylinder.

Furthermore, the suction channel in the second cylinder includes a first suction section and a second suction section, and the gas exchange slider is provided in the first Furthermore, when the gas exchange slider is at the first connecting position, the gas exchange slider separates the first suction section from the second suction section, and the first exhaust channel is connected to the second suction section through the first gas transit channel.

Furthermore, the first exhaust channel is connected to the second suction section through a first gas connection channel provided on the second cylinder and the first gas transit channel.

Furthermore, the first suction section includes a first suction part and a second suction part, when the gas exchange slider is at the second connecting position, the first suction part is connected to the second suction section.

Furthermore, the second cylinder is provided with a second gas connection channel, when the gas exchange slider is at the second connecting position, two ends of the second gas transit channel are respectively connected to an end of the first gas connection channel and an end of the second gas connection channel, another end of the second gas connection channel is connected to the second exhaust channel, and another end of the first gas connection channel is connected to the first exhaust channel.

Furthermore, a cross section of the first suction part is circular, and a cross section of the second suction part is semicircular.

Furthermore, the first exhaust channel and the second exhaust channel are both parallel to a thickness direction of the first cylinder, and an end of the first exhaust channel and an end of the second exhaust channel are both located in a cylinder wall of the second cylinder.

Furthermore, an angle between a projection of the first gas connection channel on a cross section of the second cylinder and that of the second gas connection channel is $\alpha$, and the range of $\alpha$ is $0° < \alpha < 90°$.

Furthermore, the second suction part is a bypass pipe.

The above technical solutions have the following advantages:

The compressor of the present disclosure can vary its own capacity, that is, by arranging a gas exchange slider on the side wall of the cylinder, the variation of the compressor's capacity is realized, which will meet the requirements of variation loads of the compressor in different seasons.

When the temperature difference between indoor and outdoor is small, the gas exchange slider is in the first connecting position, the compressed gas in the exhaust chamber in the first cylinder is directly introduced to the suction chamber in the second cylinder, which reduces the capacity of the compressor, and the compressor can operate at partial load and continuously operate at low load;

When the temperature difference between indoor and outdoor is large, the gas exchange slider is in the second connecting position. Compared with when the gas exchange slider in the first connecting position, the capacity of the compressor is increased and the compressor can continuously operate at full load.

Other features, advantages, as well as the structure and operation of various embodiments of the present disclosure, will be described in detail with reference to following drawings. It should be readily understood that the present disclosure is not limited to the specific embodiments described herein. The embodiments given herein are for illustrative purposes only.

BRIEF DESCRIPTION OF THE DRAWINGS

The foregoing and other features, and advantages of the present disclosure are apparent from the following detailed description taken in conjunction with the accompanying drawings in which.

REFERENCE SIGNS

Figure 1:
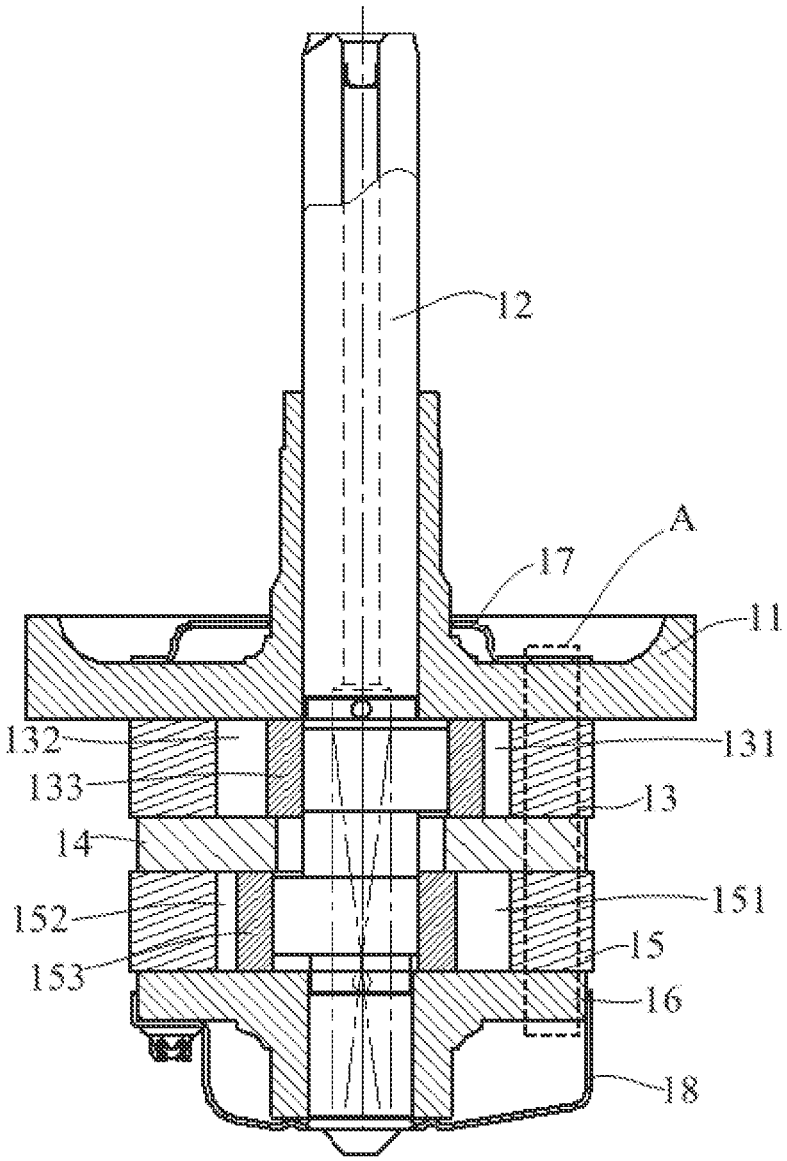
FIG. 1 is a schematic diagram of a structure of a compression assembly of the dual-cylinder two-stage variable capacity compressor.

11 upper cylinder cover
12 crankshaft
13 upper cylinder
131 first exhaust chamber
132 first suction chamber
133 first rotating piston
14 middle plate
15 lower cylinder
151 second suction chamber
152 second exhaust chamber
153 second rotating piston
16 lower cylinder cover
17 upper muffler
18 lower muffler
21 first exhaust channel
22 second exhaust channel
23 first gas connection channel
24 second gas connection channel
25 gas exchange slider
251 first gas transit channel
252 second gas transit channel
26 suction channel
261 first suction section
261*a* first suction part
261*b* second suction part
262 second suction section
27 compressor chamber The foregoing and other features and advantages of the invention are apparent from the following detailed description taken in conjunction with the accompanying drawing. Throughout the drawings, the same drawings identify corresponding elements. In the drawings, the same reference signs generally indicate the same, functionally similar, and/or structurally similar elements.

DETAILED DESCRIPTION

In the following, embodiments of the present disclosure will be described in detail with reference to the figures. The concept of the present disclosure can be implemented in a plurality of forms, and should not be understood to be limited to the embodiments described hereafter. In contrary, these embodiments are provided to make the present disclosure more comprehensive and understandable, and so the conception of the embodiments can be conveyed to those skilled in the art fully. Based on the embodiments of the present disclosure, all other embodiments obtained by those of ordinary skill in the art without creative work shall fall within the protection scope of the present disclosure.

The "first", "second" and similar words used in the present disclosure do not denote any order, quantity or importance, but are only used to distinguish different components. "comprise", "include" and other similar words mean that the elements or objects appearing before these words, the elements or objects listed after these words, and their equivalents, but other elements or objects are not excluded. Similar words such as "connected" are not limited to physical or mechanical connections, but may include electrical connections, whether direct or indirect. "up", "down", "left", "right", etc. are only used to indicate the relative position relationship. When the absolute position of the described object changes, the relative position relationship may also change accordingly.

It should be noted that the embodiments of the present disclosure and the features in the embodiments can be combined with each other if there is no conflict.

The present disclosure will be further explained below in conjunction with the drawings and specific embodiments, and the description should not be understood to be a. limitation of the present disclosure.

In some embodiments of the present disclosure, a dual-cylinder two-stage variable capacity compressor is provided.

FIG. 1 is a schematic diagram of a structure of a compression assembly of the dual-cylinder two-stage variable capacity compressor, The compression assembly shown in FIG. 1 has two cylinders, namely a lower cylinder 15 (a first cylinder) and an upper cylinder 13 (a second cylinder). The upper cylinder 13 is located at an upper part, the lower cylinder 15 is located at a lower part. The upper cylinder 13 and the lower cylinder 1.5 are separated by a middle plate 14. The upper cylinder 13 is provided with an upper cylinder cover 11 and the lower cylinder 15 is provided with a lower cylinder cover 16. The upper part of the upper cylinder 13 is provided with an upper muffler 17, and the lower part of the lower cylinder 15 is provided with a lower muffler 18. The upper cylinder 13 is provided with a first rotary piston 133. The first rotary piston 133 divides a space in the upper cylinder 13 into a first suction chamber 132 and a first exhaust chamber 131. The first rotary piston 133 is sleeved on a crankshaft 12 and the crankshaft 12 drives the first rotary piston 133 to rotate. A second rotary piston 153 is provided in the lower cylinder 15, The second rotary piston 153 divides a. space in the lower cylinder 15 into a second suction chamber 151 and a second exhaust chamber 152. The second rotary piston 153 is sleeved on the crankshaft 12 and the second rotary piston 153 is driven to rotate by the crankshaft 12.

Figure 2:
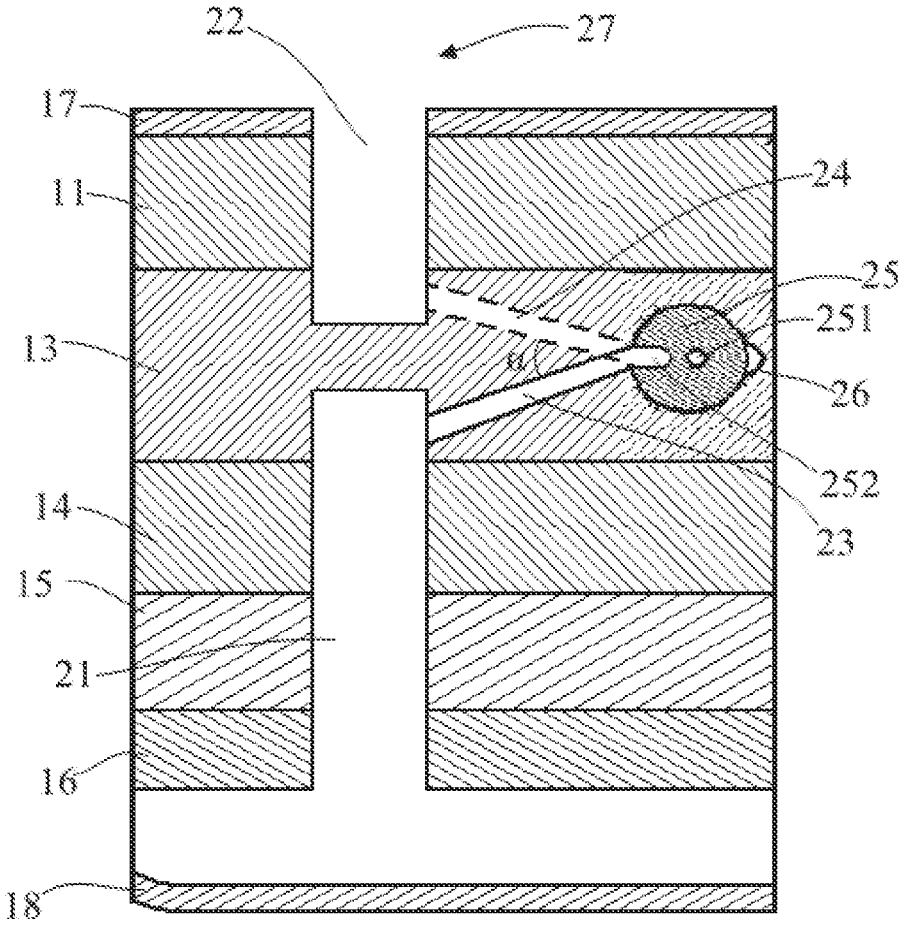
FIG. 2 is an enlarged schematic diagram of an area A in FIG. 1.

FIG. 2 is an enlarged schematic diagram of an area A in FIG. 1, and shows a first exhaust channel 21 and a second exhaust channel 22. The first exhaust channel 21 and the second exhaust channel 22 are both parallel to a thickness direction of the first cylinder, and an end of the first exhaust channel 21 and an end of the second exhaust channel 22 are both located in a cylinder wall of the second cylinder. The first exhaust channel 21 is located below the second exhaust channel 22, and the first exhaust channel 21 and the second exhaust channel 22 are coaxially arranged. The first exhaust channel 21 is composed of a blind hole provided on the cylinder wall of the upper cylinder 13, a through hole provided on the middle plate 14, a through hole provided on the cylinder wall of the lower cylinder 15 and a through hole provided on the lower cylinder cover 16. A lower end of the first exhaust channel 22 is connected to a muffler chamber of the lower muffler 18, The second exhaust channel 22 is composed of a blind hole provided in the upper cylinder 13, a through hole provided in the upper cylinder cover 11 and a through hole provided in the upper muffler 17. An upper end of the second exhaust channel 22 is connected to a compressor chamber 27 (that is, an internal space of the housing containing the compression assembly). The cylinder wall of the upper cylinder 13 is also provided with a gas exchange slider 25 that can slide along a radial direction of the upper cylinder 13. The gas exchange slider 25 includes a first gas transit channel 251 and a second gas transit channel 252. The upper cylinder 13 is provided with a first gas connection channel 23 and a second gas connection channel 24, an end of the first gas connection channel 23 is connected to the first exhaust channel 21, and an end of the second gas connection channel 24 is connected to the second exhaust channel 22. In some embodiments, an angle between a projection of the first exhaust channel 23 on a cross section of the upper cylinder 13 (the cross section shown in FIG. 2) and that of the second exhaust channel 24 is $\alpha$, and the range of $\alpha$ is $0°<\alpha<90°$.

FIG. 2 shows the position of the ventilation slider 25 (a second connecting position). When the gas exchange slider 25 is at the second connecting position, the first gas connection channel 23 and the second gas connection channel 24 are connected through the second gas transit channel 252, so that compressed gas in the exhaust chamber of the lower cylinder 15 can be discharged to compressor chamber 27 through the muffler chamber of the lower muffler 18, the first exhaust channel 21 and the second exhaust channel 22.

Figure 3:
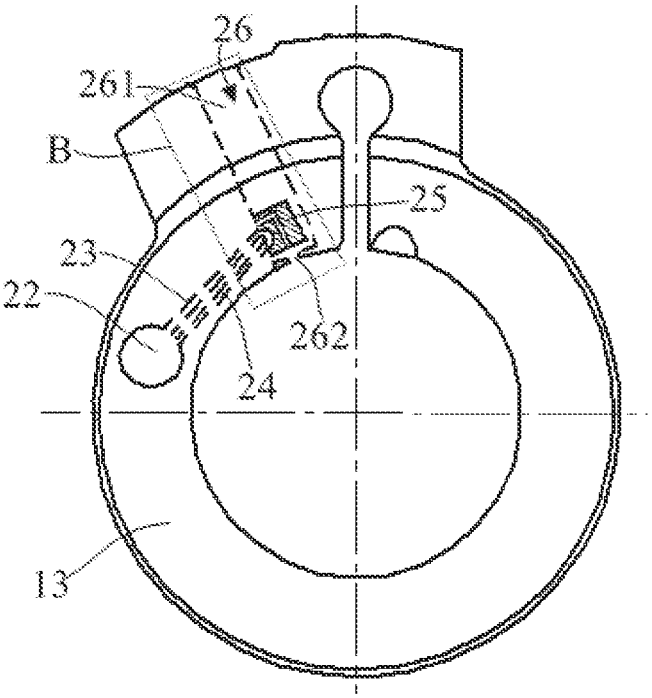
FIG. 3 is a schematic diagram of a position of the gas exchange slider in the upper cylinder.

FIG. 3 is a schematic diagram of a position of the gas exchange slider in the upper cylinder. The upper cylinder 13 shown in FIG. 3 is provided with a suction channel 26 through which the upper cylinder 13 inhales refrigerant to the suction chamber. The suction channel 26 includes a first suction section 261 and a second suction section 262. The first suction section 261 is used to introduce low-pressure refrigerant, and the second suction section 262 is connected to the suction chamber. An inner diameter of the first suction section 261 is larger than that of the second suction section 262. The gas exchange slider 25 is provided in the first suction section 261, and can slide in the radial direction of the upper cylinder 13 in the first suction section 261. As a result, the gas exchange slider 25 is capable of being switched between a first connecting position and a second connecting position. The gas exchange slider 25 shown in FIG. 3 is at the second connecting position, when the first gas connection channel 23 and the second gas connection channel 24 are connected through the second gas transit channel 252. As a result, the compressed gas in the exhaust chamber of the lower cylinder 15 can be discharged to the compressor chamber 27 through the muffler chamber of the lower muffler 18. and the first exhaust channel 21 and the second exhaust channel 22. The upper cylinder 13 and the lower cylinder 15 work independently.

Figure 4:
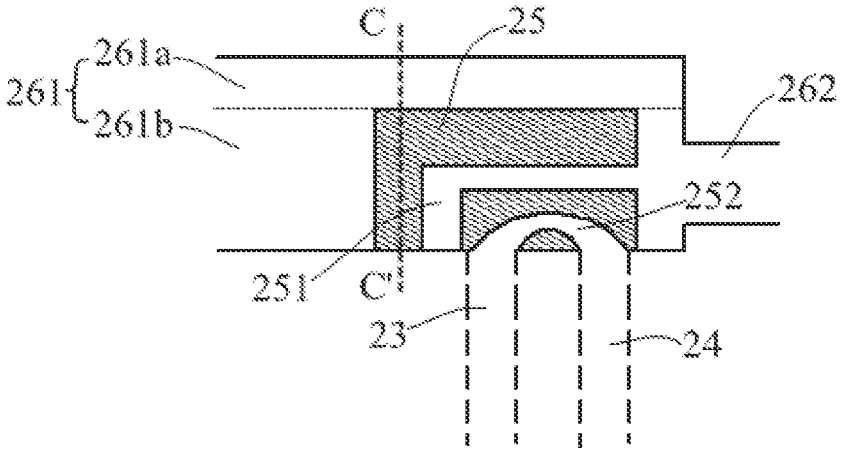
FIG. 4 is an enlarged schematic diagram of an area B in FIG. 3.

FIG. 4 is an enlarged schematic diagram of an area B in FIG. 3. The gas exchange slider 25 shown in FIG. 4 is at the second connecting position. Two ends of the second gas transit channel 252 are respectively connected to an end of the first gas connection channel 23 and an end of the second gas connection channel 24, the other end of the second gas connection channel 24 is connected to the second exhaust channel 22, and the other end of the first gas connection channel 23 is connected to the first exhaust channel 21, As a result, the compressed gas in the exhaust chamber in the lower cylinder 15 can be discharged to the compressor chamber 27 through the muffler chamber of the lower muffler 18, the first exhaust channel 21 and the second exhaust channel 22. The first suction section 261 includes a first suction part 261*a* and a second suction part 261*b*, wherein the second suction part 261*b* can be a bypass pipe. When the gas exchange slider 25 is at the second connecting position, the first suction part 261*a* is connected to the second suction section 262 and the low-pressure refrigerant flows into the suction chamber of the upper cylinder 13 through the first suction part 261*a* and the second suction part 262, as a result, the compressor is at full load, that is, the upper cylinder 13 and lower cylinder 15 work independently, The above-mentioned state of the compressor is suitable for situations when the temperature difference between indoor and outdoor is large, the compressor can continuously operate at full load, that is, the upper cylinders 13 and lower cylinder 15 work independently.

Figure 5:
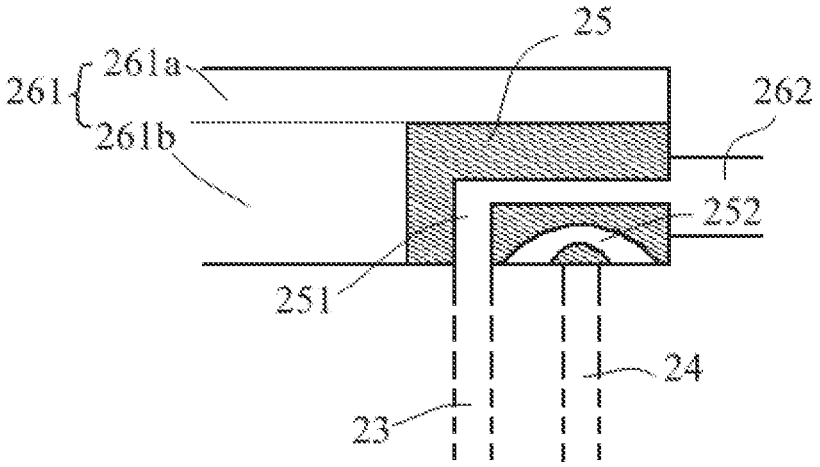
FIG. 5 is a schematic diagram of a structure when the gas exchange slider is in the first connecting position.

FIG. 5 is a schematic diagram of a structure when the gas exchange slider is in the first connecting position. The gas exchange slider 25 shown in FIG. 5 is at the first connecting position, and the first exhaust channel 21 is connected to the suction channel 26 of the second cylinder, that is, the second suction section 262, through the first gas transit channel 251.

The first gas transit channel 251 is composed of two straight segments, and the second gas transit channel 252 is in a shape of an arc. Two ports of the first gas transit channel 251 are respectively located on an end surface and a side surface of the ventilation slider 25. Two ports of the second gas transit channel 252 are both located on the side surface of the gas exchange slider 25 and arranged in a straight line with one port of the first gas transit channel 251. In this state, the first suction section 261 and the second suction section 262 are blocked by the gas exchange slider 25, and the compressed gas discharged from the exhaust chamber in the lower cylinder 15 flows into a first suction chamber 132 in the upper cylinder 13 through the first exhaust channel 21, the first gas connection channel 23, the first gas transit channel 251 and the second suction section 262, When the ventilation slider 25 is at the first connecting position, the compressed gas in the second exhaust chamber 152 in the lower cylinder 15 is introduced to the first suction chamber 132 in the lower cylinder 15, it means that the upper cylinder and lower cylinder 15 are in serious connected. As a result, the compressor exhaust capacity is reduced. The ventilation slider 25 is at the first communicating position, which is suitable for situations when the temperature difference between indoor and outdoor is small. In the above state, the compressed gas in the exhaust chamber in the lower cylinder 15 is directly introduced into the suction chamber in the upper cylinder 13, thereby reducing the capacity of the compressor and achieving partial load operation of the compressor, and continuous small load operation.

Figure 6:
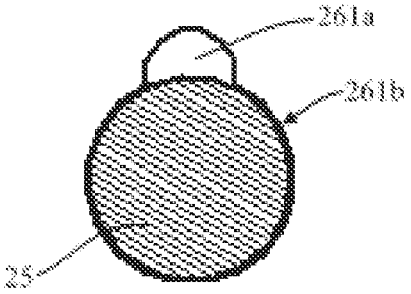
FIG. 6 is a cross-sectional diagram along CC' in FIG. 4.

FIG. 6 is a cross-sectional diagram along CC' in FIG. 4. A cross section of the first suction part 261*a* shown in FIG, 6 is circular, and a cross section of the second suction part 261*b* is semicircular.

In summary, the compressor of the present disclosure can vary its own capacity, that is by arranging a gas exchange slider on the side wall of the cylinder, the variation of the compressor's capacity is realized, which will meet the requirements of variation loads of the compressor in different seasons.

When the temperature difference between indoor and outdoor is small, the gas exchange slider is in the first connecting position, the compressed gas in the exhaust chamber in the first cylinder is directly introduced to the suction chamber in the second cylinder, which reduces the capacity of the compressor, and the compressor can operate at partial load and continuously operate at low load;

When the temperature difference between indoor and outdoor is large, the gas exchange slider is in the second connecting position. Compared with when the gas exchange slider in the first connecting position, the capacity of the compressor is increased and the compressor can continuously operate at full load.

The preferred embodiments of the present disclosure have been described in detail above. It should be understood that those skilled in the art can make many modifications and changes according to the concept of the present disclosure without creative work. Therefore, any technical solution that can be obtained by a person who skilled in art through logical analysis, reasoning, or limited experimentation based on the concept of the present disclosure on the basis of the prior art shall fall within the protection scope determined by the claims.

The invention claimed is:

1. A dual-cylinder two-stage variable capacity compressor, comprising:

a first cylinder, having an exhaust port connected to a first exhaust channel;

a second cylinder, wherein the second cylinder and the first cylinder are separated by a middle plate, the second cylinder is provided with a gas exchange slider, and the gas exchange slider is provided with a first gas transit channel and a. second gas transit channel;

wherein, when the gas exchange slider is at a. first connecting position, the first exhaust channel is connected to a suction channel in a second cylinder through the first gas transit channel;

when the gas exchange slider is at a second connecting position, the first exhaust channel is connected to a second exhaust channel through the second gas transit channel, the second exhaust channel is connected to an inner chamber of the compressor.

2. The dual-cylinder two-stage variable capacity compressor of claim 1, wherein the first cylinder is an upper cylinder and the second cylinder is a lower cylinder.

3. The dual-cylinder two-stage variable capacity compressor of claim 1, wherein the suction channel in the second cylinder comprises a first suction section and a second suction section, and the gas exchange slider is provided in the first suction section.

4. The dual-cylinder two-stage variable capacity compressor of claim 3, wherein when the gas exchange slider is at the first connecting position, the gas exchange slider separates the first suction section from the second suction section, and the first exhaust channel is connected to the second suction section through the first gas transit channel.

5. The dual-cylinder two-stage variable capacity compressor of claim 4, wherein the first exhaust channel is connected to the second suction section through a first gas connection channel provided on the second cylinder and the first gas transit channel.

6. The dual-cylinder two-stage variable capacity compressor of claim 5, wherein the second cylinder is provided with a second gas connection channel, when the gas exchange slider is at the second connecting position, two ends of the second gas transit channel are respectively connected to an end of the first gas connection channel and an end of the second gas connection channel, another end of the second gas connection channel is connected to the second exhaust channel, and another end of the first gas connection channel is connected to the first exhaust channel.

7. The variable capacity compressor of claim 6, wherein an angle between a. projection of the first gas connection channel on a cross section of the second cylinder and that of the second gas connection channel is $\alpha$, and the range of $\alpha$is $0°<\alpha<90°$.

8. The dual-cylinder two-stage variable capacity compressor of claim 3, wherein the first suction section comprises a first suction part and a second suction part, when the gas exchange slider is at the second connecting position, the first suction part is connected to the second suction section.

9. The dual-cylinder two-stage variable capacity compressor of claim 8, wherein the second suction part is a bypass pipe.

10. The dual-cylinder two-stage variable capacity compressor of claim 3, wherein the first exhaust channel and the second exhaust channel are both parallel to a thickness direction of the first cylinder, and an end of the first exhaust channel and an end of the second exhaust channel are both located in a cylinder wall of the second cylinder.

* * * * *